US006394062B2

(12) United States Patent
Daly et al.

(10) Patent No.: US 6,394,062 B2
(45) Date of Patent: May 28, 2002

(54) DUST SENSING ASSEMBLY AIR INTAKE SYSTEM

(75) Inventors: Paul D. Daly, Troy, MI (US); James K. Vanderveen, Blenheim (CA)

(73) Assignee: Siemens Canada Limited, Tilbury (CA)

( * ) Notice: Subject to any disclaimer, the term of this patent is extended or adjusted under 35 U.S.C. 154(b) by 0 days.

(21) Appl. No.: 09/814,228

(22) Filed: Mar. 21, 2001

Related U.S. Application Data

(60) Provisional application No. 60/269,083, filed on Feb. 15, 2001, and provisional application No. 60/193,225, filed on Mar. 30, 2000.

(51) Int. Cl.[7] ..... F01P 5/14
(52) U.S. Cl. ..... 123/198 E; 181/206
(58) Field of Search ..... 123/198 E; 181/206

(56) References Cited

U.S. PATENT DOCUMENTS 4,456,883 A * 6/1984 Bullis ..... 324/464
5,059,221 A * 10/1991 McWilliam ..... 123/198 E
5,207,186 A * 5/1993 Okita ..... 123/198 E
5,446,790 A 8/1995 Tanaka
5,730,769 A * 3/1998 Dongs et al. ..... 123/198 E
5,828,759 A 10/1998 Everingham
5,913,295 A * 6/1999 Sador et al. ..... 123/198 E
6,084,971 A 7/2000 McLean
6,162,269 A * 12/2000 Greenless et al. ..... 123/198 E

OTHER PUBLICATIONS

Article—Averdieck, "Particulate Monitoring With Electrodynamic Technology", Pollution Equipment News, Aug. 1997.

Article—Bugli, "Filter Performance Requirements for Engine Air Induction Systems", SAE Paper 970556, 1997.

* cited by examiner

*Primary Examiner*—Paul J. Hirsch

(57) ABSTRACT

An air induction system for a vehicle engine includes a sensor assembly for monitoring particulate concentration. The sensor assembly is mounted within an air intake housing, which has an inlet and an outlet. An airflow passageway extends between the inlet and the outlet to the vehicle engine. An air filter is mounted within the housing to filter particulates from air flowing through the airflow passageway. The sensor assembly can be mounted to an intake manifold or incorporated into a mass airflow sensor. The particulate sensor generates a particulate signal representative of particulate concentration entering the vehicle engine via the outlet. The signal is sent to an output device monitored by a vehicle operator.

15 Claims, 1 Drawing Sheet

DUST SENSING ASSEMBLY AIR INTAKE SYSTEM

RELATED APPLICATION

This application claims priority to provisional applications No. 60/193,225 filed on Mar. 30, 2000 and No. 60/269,083 filed on Feb. 15, 2001.

BACKGROUND OF THE INVENTION

1. Field of the Invention

This invention relates to an integrated dust sensing assembly for a vehicle air intake system. Specifically, a dust sensor is mounted to an intake manifold or integrated into a mass air flow sensor unit to monitor the dust intake to an engine.

2. Related Art

Internal combustion engines include air induction systems for conducting air to the engine. Engine noise is propagated through the air induction systems, which is undesirable. Noise attenuation mechanisms have been installed within the air induction systems to reduce these noises. Typically these noise attenuation mechanisms include a speaker, a sound detector, a signal generator, and various other components that are used to reduce noise generated by the air induction system. These components are mounted within an air duct housing.

Often, the air that is drawn into the system through the air duct housing includes dust, dirt, and other particulate contaminants. These contaminants can clog the engine resulting in poor performance. An air filter is typically installed within the air induction system to remove these contaminants from the airflow prior to the air being drawn into the engine. Sometimes the air filter is not properly installed or becomes damaged during vehicle operation, which allows the contaminants to enter the engine. It is desirable to be able to accurately monitor dust, dirt, and particulate concentration levels before the air enters the engine to determine if the air filter system is operating properly.

One disadvantage with air filters is that the system experiences a pressure drop as the air is drawn through the filter. Even when the airflow is generally clean, i.e., the air does not include a high level of contaminants, the air is drawn through the filter. It is desirable to include a by-pass mechanism that works in conjunction with a particulate monitor to by-pass the filter mechanism when the airflow has minimal particulate concentrations.

It is the object of the present invention to provide a simple and effective apparatus and method for monitoring particulate concentrations to overcome the deficiencies outlined above.

SUMMARY OF THE INVENTION

An air intake or induction system includes a particulate sensor that sends a particulate signal representative of the particulate concentration entering a vehicle engine to an output device monitored by a vehicle operator. If particulate concentration levels are higher, the signal can alert the operator that the filter is improperly installed, the filter has a hole or other damage, or that the clean air hose has been disconnected. These early detections allow the operator to correct the problems when they occur, thus reducing engine wear.

In the preferred embodiment, the air induction system includes an air intake housing with an inlet and an outlet and defining an airflow passageway between the inlet and the outlet. An air filter is mounted within the housing to filter particulates from air flowing through the airflow passageway. A particulate sensor is mounted within the housing downstream from the filter to generate a particulate signal representative of particulate concentration entering the vehicle engine via the outlet.

Preferably, the particulate sensor is a triboelectric sensor that is mounted to an intake manifold or integrated within a mass air flow sensor mounted downstream from the filter for generating a mass airflow signal representative of the amount of air flowing through the passageway. The mass air flow signal can be used for calibration purposes because the output sensor current for a triboelectric sensor is proportional to the square of the velocity of the dust or dirt particulates. This means that the particulate sensor is more sensitive at high flow rates and least sensitive at low flow rates so that a particulate sensing calibration curve can reflect this phenomena.

In one embodiment, air intake housing includes a first airflow passageway for directing airflow from the inlet through the filter to the outlet and a second airflow passageway for directing airflow from the inlet around the filter to the outlet. The second airflow passageway is activated only when the particulate signal is below a predetermined concentration level. In this configuration, an upstream particulate sensor, i.e. a sensor in front of the air filter, is needed. A by-pass mechanism is mounted within the housing upstream from the filter to close off the first airflow passageway and open the second airflow passageway when the particulate signal is below a predetermined concentration level.

The method for monitoring particulate concentration in an air induction system includes the following steps. Air is drawn into the inlet and through the air filter, particulate concentration is sensed downstream from the air filter, and a particulate signal is generated that represents particulate concentration. The signal is sent to an output device. Additional steps include installing a by-pass mechanism upstream from the air filter and activating the by-pass mechanism when the particulate signal is below a predetermined concentration level to direct airflow from the first passageway to the second passageway around the filter.

The subject apparatus provides a simple method for monitoring dust and dirt particulate concentration levels that are entering a vehicle engine. This results in reduced engine wear and can extend filter life when the by-pass mechanism is utilized.

These and other features of the present invention can be best understood from the following specification and drawings, the following of which is a brief description.

DETAILED DESCRIPTION OF AN EXEMPLARY EMBODIMENT

Figure 1:
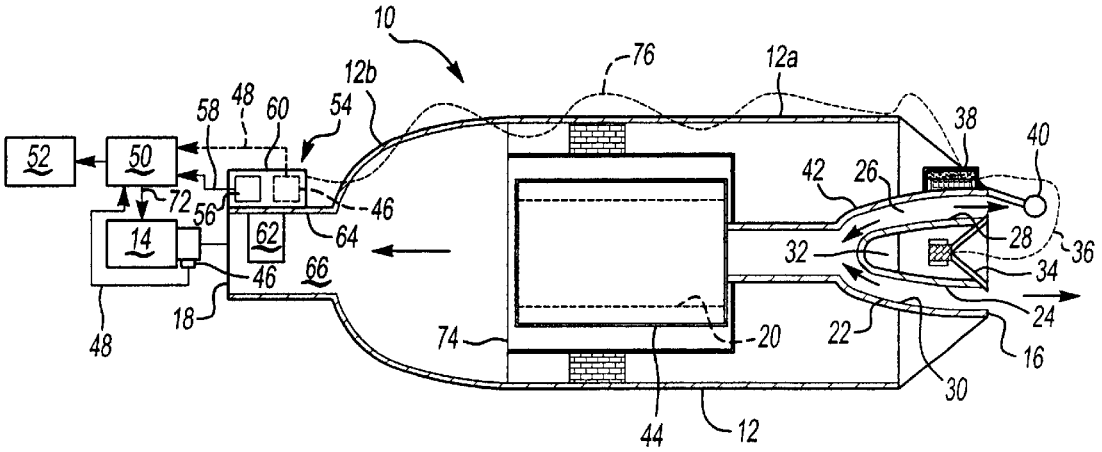
FIG. 1 is a schematic diagram of an air induction system with an active noise attenuation assembly and integrated particulate sensor.

Referring to the drawings, FIG. 1 shows an air intake or induction system 10 including an air intake housing 12 forming part of noise attenuation assembly. The air induction system 10 provides air to an internal combustion engine 14. The air intake housing 12 has an inlet 16 and an outlet 18 and an airflow passageway 20 that extends between the inlet and the outlet.

Mounted within the air intake housing 12 is a speaker housing 22 and a mid-body portion 24 is mounted within the speaker housing 22. The mid-body portion 24 is concentrically positioned within speaker housing 22 on a pair of integrally formed struts (not shown) to define an annular passage 26 between an exterior surface 28 of the mid-body portion 20 and an interior surface 30 of the speaker housing 12. The mid-body portion 20 is preferably parabola shaped to define a central chamber 32 with a tapered bottom end facing the engine 14 and an open end facing away from the engine 14.

A speaker assembly 34 is mounted within the chamber 32 and includes a speaker connector 36 that is operably connected to an electronics center 38. The electronics center 38 can include a controller, microprocessor unit, or other similar device whose operation is well known in the art.

A sound detector 40, such as a microphone for example, is mounted adjacent to the speaker housing 22 to sense noise emanating though the air intake housing 12. The sound detector 40 generates a noise signal that is sent to the electronics center 38 where the signal is phase-shifted by approximately 180 degrees. The phase-shifted signal is then sent to the speaker 34 to generate a sound field that cancels out or attenuates the noise detected by the sound detector 40.

The electronics center 38 is mounted to an exterior surface 42 of the speaker housing 22. The sound detector 40 is preferably mounted adjacent to the annular passage 26 in a forward position extending beyond the open end of the speaker housing 22.

An air filter 44 is mounted within the air intake housing 12 downstream from the noise attenuation system. The air filter 44 filters out dust, dirt, and other particulate contaminants that are drawn into the air intake housing 12. A particulate sensor assembly 46 is mounted between the air filter 44 and the engine 14. The particulate sensor assembly 46 generates a particulate signal 48 that represents the particulate concentration level prior to air entering the engine 14. The signal 48 is sent to an engine management system 50, which includes a system controller or microprocessor. The signal 48 can then be sent to an output device 52 such as a graphical display that can give a visual or an audible warning if particulate concentration levels are higher than a predetermined minimum.

Preferably, the particulate sensor assembly 46 is mounted on an intake manifold positioned next to the engine 14. Optionally, the particulate sensor assembly 46, indicated in dashed lines, can be integrated into a mass air flow sensor assembly 54 mounted between the air filter 44 and the engine 14. An intake manifold mount is preferred to better protect the engine 14. If the clean air hose is disconnected, the particulate sensor assembly 46 in this configuration will be able to detect the hose disconnect.

The mass air flow sensor assembly includes a flow sensor 56 that monitors the amount (mass per second) of air flowing through the air intake housing 12 and generates a signal 58 that is representative of such air flow. The flow sensor 56 and the particulate sensor 46 are preferably positioned within a common housing 60 for the mass air flow sensor assembly 54. The housing 60 is mounted to an exterior surface of the air intake housing 12. A probe member 62 for the particulate sensor 46 extends through a wall 64 of the housing 12 into an airflow passage 66 located downstream from the air filter 44.

Preferably, the air intake housing 12 is a two (2) piece housing whose pieces can be selectively separated for service purposes. The housing 12 has a first section 12*a* that houses the speaker housing 22 and the air filter 44 and a second section 12*b* that supports the mass air flow sensor assembly 54 and integrated particulate sensor 46. The housing sections 12*a*, 12*b* are connected at a service joint 74. The housings 12*a*, 12*b* can be connected by fasteners or other similar means that provide easy assembly and disassembly.

The electronics center 38 for the noise attenuation system is mounted within the first housing section 12*a* and is connected via a flex cable or wire assembly 76 to the mass air flow sensor assembly 54. Optionally, the electronics center 38 could also be attached via the flex cable 76 to the engine management system 50.

Preferably, all of the electronics are integrated into the mass air flow sensor assembly 54 and digital signal processor of the engine management system 50 at the back end of the filter 44 and sensor assembly 54. This leaves only one connector, cable 76 from the sound detector 40 at the front of the housing 12. The sound detector 40 can be supported on flexible mount similar to a CB radio antennae and can be shipped folded in.

Figure 2:
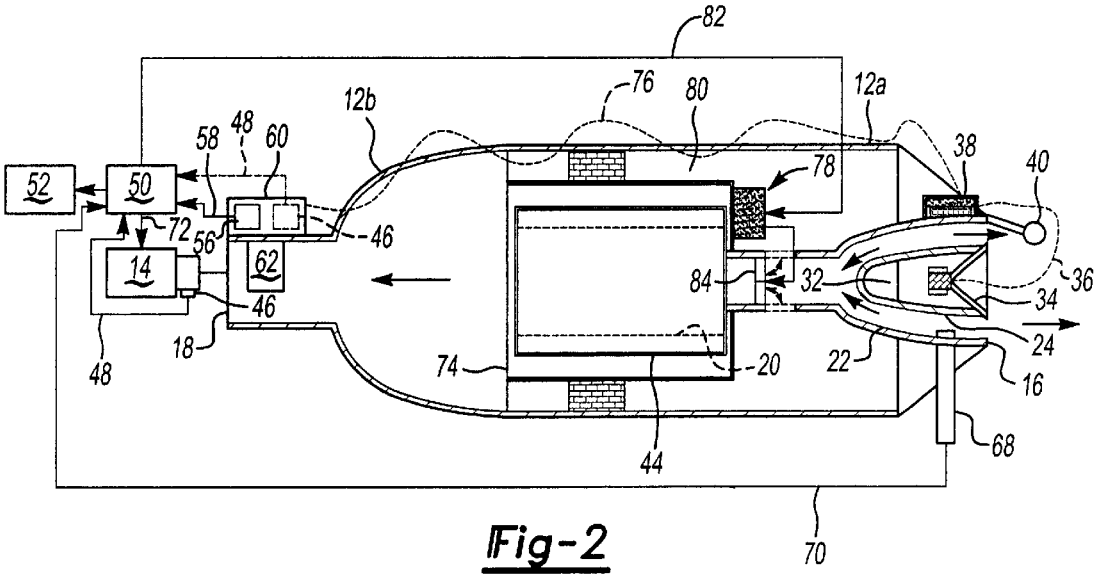
FIG. 2 is a schematic diagram of an air induction system with an active noise attenuation assembly, integrated particulate sensor, and by-pass mechanism.

FIG. 2 shows an alternate embodiment of the air induction system that includes a by-pass mechanism 78. The by-pass mechanism 78 is activated if the particulate signal 48 indicates that the air is clean, i.e., the particulate concentration is below a predetermined amount. When the by-pass mechanism 78 is activated, the air does not require filtering and thus is directed around the filter 44. This avoids the air pressure drop associated with air flowing through the filter 44 and lengthens filter life.

The air intake housing 12 with the by-pass mechanism 78 is modified to include the first airflow passageway 20 from the inlet 16 through the filter 44 and out the outlet 18 and a second airflow passageway 80 from the inlet 16 around the filter 44 to the outlet 18. When particulate concentration levels are below a predetermined minimum level, a control signal 82 is sent to the by-pass mechanism 78 to direct air from the first passageway 20 to the second passageway 80.

In one embodiment, the by-pass mechanism 78 includes doors or flapper valves 84 that are activated by the control signal 82. The door 84 is preferably positioned in front of the first passageway 20 and folds inwardly (as indicated by the arrows) to seal off airflow through the filter. When particulate concentration levels are high, the door 84 is flips outwardly to seal off the second passageway 80. While a door or flapper valve type by-pass is preferred, other similar mechanisms known in the art could also be used.

In the by-pass embodiment, an upstream particulate sensor 68 is mounted adjacent to the inlet 16 of the air intake housing 12. The upstream particulate sensor 68 generates a second particulate signal 70 that is sent to the engine management system 50. The second particulate signal 70 is compared to a predetermined value to determine whether or not the by-pass mechanism 78 should be activated. The predetermined value can be a look-up table or other similar data file stored in the engine management system 50. If the second particulate signal 70 indicates that the particulate levels are below a predetermined value then the by-pass mechanism 78 is activated. If the signal 78 indicates that the particulate levels are above a predetermined level, the by-pass mechanism 78 will not be activated.

Additionally, information from the particulate signals 48, 70 and the air flow signal 58 can be used to generated an engine control signal 72 to adjust different engine parameters as is known in the art.

Figure 3:
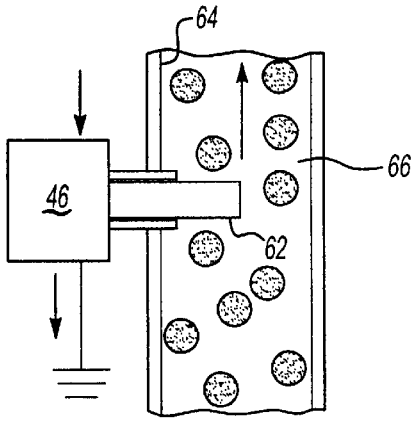
FIG. 3 is a schematic diagram of the subject particulate sensor.

The particulate sensor 46 is preferably a triboelectric sensor, shown in FIG. 3. As discussed above, the sensor 46 includes a probe member 62 that extends through a wall 64 of the housing 12 and into the center of the airflow cavity 66 that leads to the engine 14. As dust particles collide with the probe 62 they generate a charge transfer generating a small current. This current then can be converted into a voltage signal. This process is known as frictional electrification. The current (I) is equal to the particle concentration (K) multiplied by a calibration factor (C), which is multiplied by the square of the velocity of material (V). $I=K*C*V^2$.

As discussed above, the sensor 46 is preferably integrated with the mass air flow sensor assembly 54 so that the mass air flow signal 58 can be used for calibration purpose since for a triboelectric sensor the output sensor current is proportional to the square of the velocity of the particles. This means that the sensor is more sensitive at high flow rates and is least sensitive at low flow rates so the dust sensing calibration curve can reflect this phenomena.

The triboelectric sensor can detect dust concentrations as low as 0.000002 grams per dry cubic meter (0.005 $mg/m^3$). It is preferred over opacity sensors because the triboelectric sensor is 500 times more sensitive to dust concentration levels.

If the sensor 46 is mounted within a plastic housing, an electrostatic Faraday shield should be used to surround the housing portion where the sensor 46 is located. This will prevent the detection of stray electric fields.

The sensor 46 could optionally be combined with a low pressure sensor, i.e. a sensor that can detect a pressure change of ten (10) in water, which would send an output signal to the operator that the air filter 44 would need to be changed.

The method for monitoring particulate concentration in an air induction system includes the following steps. Air is drawn into the inlet and through the air filter 44, particulate concentration is sensed downstream from the air filter 44, and a particulate signal 48 is generated that represents particulate concentration. The signal is sent to an output device 52. Additional steps include installing a by-pass mechanism 78 upstream from the air filter 44 and activating the by-pass mechanism 78 when the particulate signal is below a predetermined concentration level to direct airflow from the first passageway 20 to the second passageway 80 around the filter 44.

The subject invention provides a method an apparatus for monitoring dust particle concentrations which can be used to send a signal to alert a vehicle operator of dust entering the engine due to incorrect filter installation, or to indicate a damaged filter, or to indicate a disengaged hose connection. This allows the operator to correct the problem as it occurs thereby reducing engine wear. Additionally, the signal can be used to activate a by-pass mechanism when the vehicle is not operating in a dusty environment thereby extending filter life and decreasing the overall pressure drop in the intake system (increasing engine horsepower).

Although a preferred embodiment of this invention has been disclosed, it should be understood that a worker of ordinary skill in the art would recognize many modifications come within the scope of this invention. For that reason, the following claims should be studied to determine the true scope and content of this invention.

What is claimed is:

1. An air induction system for a vehicle engine comprising:

an air intake housing having an inlet and an outlet and defining an airflow passageway between said inlet and said outlet;

an air filter mounted within said housing to filter particulates from air flowing through said airflow passageway; and a particulate sensor mounted within said housing downstream from said filter for generating a particulate signal representative of particulate concentration entering a vehicle engine via said outlet.

2. A system according to claim 1 wherein said particulate sensor includes a body portion mounted to said housing and a probe member extending into said airflow passageway.

3. A system according to claim 2 including a mass airflow sensor unit mounted to an exterior surface of said housing wherein said body portion of said particulate sensor is integrated into said mass airflow sensor unit with said probe member extending through a wall of said housing into said airflow passageway.

4. A system according to claim 2 wherein said housing includes a first housing portion for partially enclosing a noise attenuation system positioned at said inlet and said filter and a second housing portion selectively detachable from said first housing portion for supporting said particulate sensor adjacent to said outlet.

5. A system according to claim 2 wherein said airflow passageway is a first airflow passageway for directing airflow from said inlet through said filter to said outlet and wherein said housing includes a second airflow passageway for directing airflow from said inlet around said filter to said outlet, said second airflow passageway being activated when said particulate signal is below a predetermined concentration level.

6. A system according to claim 5 including a by-pass mechanism mounted within said housing upstream from said filter for closing said first airflow passageway and opening said second airflow passageway when said particulate signal is below a predetermined concentration level.

7. A system according to claim 6 including a controller for receiving said particulate signal and generating a control signal to control movement of said by-pass mechanism.

8. A system according to claim 1 including a second particulate sensor mounted upstream from said air filter adjacent to said inlet for generating a second particulate signal that is compared to said first particulate signal to determine filter efficiency.

9. A system according to claim 1 wherein said sensor is mounted to an engine intake manifold.

10. A system according to claim 1 wherein said signal is sent to an engine management system having a controller that processes said signal and sends a control signal to an output device.

11. A method for monitoring particulate concentration in an air induction system for a vehicle engine comprising the steps of:

(a) providing an air duct housing with an inlet and an outlet and an air filter mounted within the housing;

(b) drawing air into the inlet and through the air filter;

(c) sensing particulate concentration downstream from the air filter; and (d) generating a particulate signal representative of particulate concentration and sending the signal to an output device.

12. A method according to claim 11 including the steps of providing a first airflow passageway from the inlet through the filter and out the outlet and a second airflow passageway from the inlet around the filter and out the outlet, installing a by-pass mechanism upstream from the air filter, and activating the by-pass mechanism when the particulate signal is below a predetermined concentration level to direct airflow from the first passageway to the second passageway.

13. A method according to claim 11 wherein step (c) further includes extending a probe member into an airflow passage adjacent to the outlet to generate the signal.

14. A method according to claim 13 including the steps of providing a mass air flow sensor unit mounted to the housing and incorporating the probe member into the mass air flow sensor unit.

15. A method according to claim 11 including sensing a particulate concentration upstream from the filter, generating a second particulate signal representative of upstream particulate concentration and comparing the second particulate signal to the first particulate signal to determine air filter efficiency.

* * * * *